US006236376B1

(12) United States Patent
Ors

(10) Patent No.: US 6,236,376 B1
(45) Date of Patent: May 22, 2001

(54) SUSPENSION DEVICE

(75) Inventor: Göran Ors, Tyresö (SE)

(73) Assignee: Sivers Lab AB, Kista (SE)

( * ) Notice: Subject to any disclaimer, the term of this patent is extended or adjusted under 35 U.S.C. 154(b) by 0 days.

(21) Appl. No.: 09/333,883

(22) Filed: Jun. 15, 1999

(30) Foreign Application Priority Data

Jun. 18, 1998 (SE) ..... 9802199

(51) Int. Cl.[7] ..... H01Q 3/02
(52) U.S. Cl. ..... 343/882; 343/766; 248/183
(58) Field of Search ..... 343/765, 766, 343/882; 248/183, 184, 514, 515

(56) References Cited

U.S. PATENT DOCUMENTS

| | | | | |
|---|---|---|---|---|
| 4,988,963 | | 1/1991 | Shirosaka et al. | 333/261 |
| 5,140,289 | | 8/1992 | Andrieu et al. | 333/256 |
| 5,212,493 | * | 5/1993 | Cluniat et al. | 343/765 |
| 6,023,247 | * | 2/2000 | Rodeffer | 343/882 |

FOREIGN PATENT DOCUMENTS

| | | |
|---|---|---|
| 771728 | 10/1934 | (FR) . |
| 07326452 | 12/1995 | (JP) . |
| WO94/26001 | 11/1994 | (WO) . |
| WO95/18471 | 7/1995 | (WO) . |

* cited by examiner

*Primary Examiner*—Tan Ho
(74) *Attorney, Agent, or Firm*—Burns, Doane, Swecker & Mathis LLP

(57) ABSTRACT

A suspension device for rotatable appliances, such as antennas, of the type which for rotation is connectible with a frame-mounted shaft which extends through a power operated disk or a similar antenna mounting and which, beyond the antenna mounting, has a free end mounted in a stationary part, which is capable of limited motion generated rated by insufficient concentricity between the antenna mounting and the shaft. An angle-transducing device is provided for said shaft. A connector is arranged adjacent to or round the shaft and directs components of force on the stationary part which have arisen owing to sufficient concentricity to merely displacement in the X-Y direction in a plane perpendicular to the shaft, by the connector being displaceably fixed in the X direction to the stationary part and displaceably fixed in the Y direction to the frame, or by the connector being displaceably fixed in the X direction to the shaft and displaceably fixed in the Y direction to the antenna mounting.

21 Claims, 10 Drawing Sheets

SUSPENSION DEVICE

FIELD OF THE INVENTION

The present invention relates to a suspension device for rotating appliances, such as antennas, of the type which for rotation is connectible with a frame-mounted shaft which extends through a power operated disk or a similar antenna mounting and which, beyond the antenna mounting, has a free end mounted in a stationary part, which is capable of limited motion generated by insufficient concentricity between the antenna mounting and the shaft, for which an angle-transducing device is arranged.

BACKGROUND ART

From frame-mounted rotatable antennas, signals are transmitted to a stationary installation for processing and evaluation. In, for instance, radar antennas, the rotational angular position of the antenna is relevant for the evaluation of the signals. The transmission occurs via a transmitter, a rotating member, which is theoretically coaxial with the axis of rotation of the antenna, to a stationary installation for processing the signals. Therefore, in such antennas there is at least one angle-transducing device connected to one of the rotary parts of the antenna.

The prior-art technique of suspending the rotating member is inaccurate owing to the fact that in actual practice it is very difficult to mount the shaft of the rotating member concentrically with the antenna shaft, so that the angle-transducing device provides correct information on the rotational angular position of the antenna. There will always be a certain eccentric and inclination error between the antenna shaft and the mounting of the shaft, which causes errors in the angle transducing.

If the stationary part is rigidly fixed to the frame, forces will arise, which are a great stress on the components included in the antenna suspension. This results in a short service life, short service intervals and great expenses for repair and spare parts.

SUMMARY OF THE INVENTION

The object of the present invention is to eliminate the above deficiency in connection with angle transducing of the prior-art suspension devices for rotatable appliances and to achieve the extremely great accuracy in angle reproduction that is necessary for, for instance, modern radar systems, and to keep the expenses down for repair, maintenance and spare parts.

According to the invention, this object is achieved by a device according to the introductory part, which comprises a connector which is arranged adjacent to or round the rotating member and directs components of force on the stationary part, which have arisen owing to insufficient concentricity, to merely displacement in the X-Y direction in a plane perpendicular to the shaft by the connector being displaceably fixed in the X direction to the stationary part and displaceably fixed in the Y direction of the frame, or by the connector being displaceably fixed in the X direction to the antenna shaft and displaceably fixed in the Y direction to the antenna mounting.

Further developments of the invention are evident from the features that are stated in the dependent claims.

BRIEF DESCRIPTION OF THE DRAWINGS

Preferred embodiments of the invention will now be illustrated for the purpose of exemplification and with reference to the accompanying drawings, in which.

DESCRIPTION OF PREFERRED EMBODIMENTS

Figure 1:
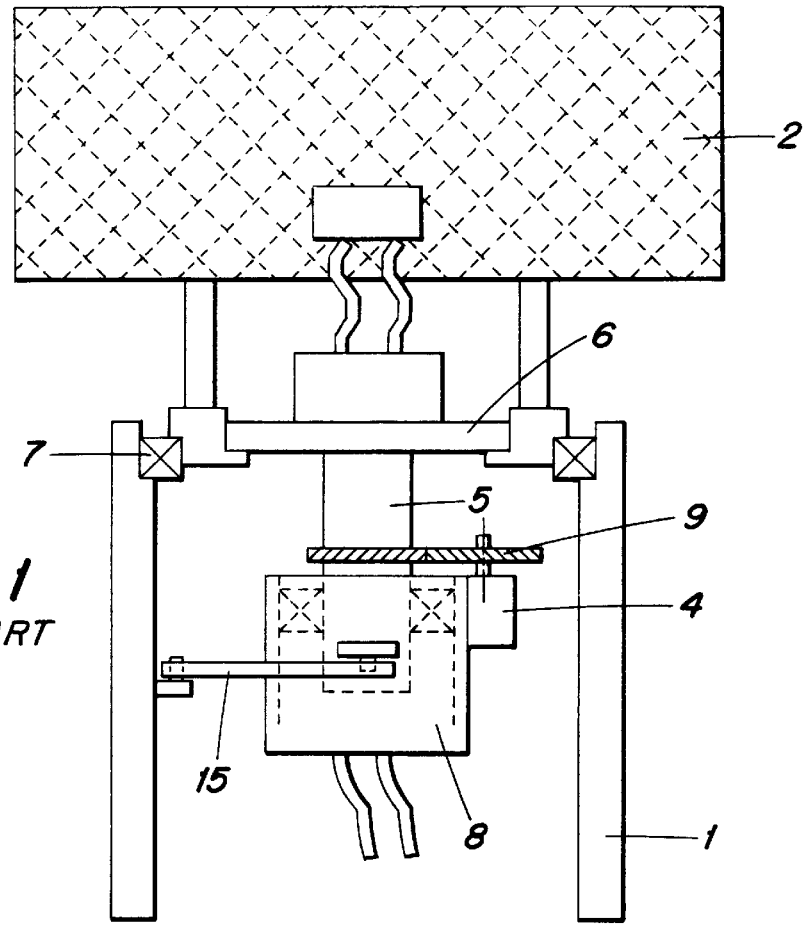
FIG. 1 PRIOR ART
FIG. 1 is a side view of prior-art technique.

A prior-art suspension device for a rotatable antenna comprises a frame 1, in which an antenna 2 is rotatably mounted. From the antenna, signals are transmitted via a transmitter, a rotating member 3, which is theoretically coaxial with the axis of rotation of the antenna, to a stationary installation (not shown) for processing the signals. The rotational angular position of the antenna is read by means of an angle-transducing device 4, which is fixed to the rotating member 3.

The rotating member 3 is divided into a rotating part and a stationary part. The rotating part comprises a shaft 5, which is non-rotationally connected to the antenna 2 and comprises cables C both to the antenna 2 and to the stationary installation and a power operated disk 6 for rotating the shaft 5 of the rotating member 3.

The power operated disk 6 is on its circumference mounted in the frame 1 by means of a rotation bearing 7, and the shaft 5 of the rotating member 3 is permanently fixed to the disk 6. The stationary part comprises a casing 8 for an arrangement of said transmission of signals to the stationary installation and for rotational mounting of the lower end of the shaft, see the bearing 8'. The angle-transducing device 4 is fixedly connected to the casing 8 and engages the shaft 5 of the rotating member 3 by means of a gear 9.

Figure 2:
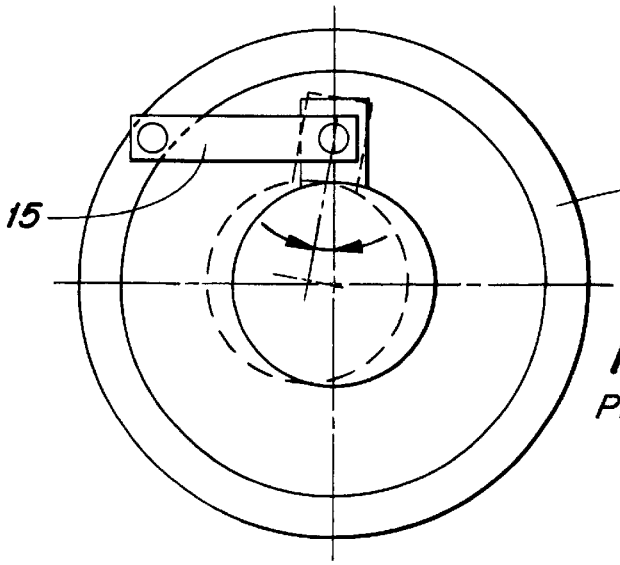
FIG. 2 PRIOR ART
FIG. 2 is a bottom view of prior-art technique.

The shaft 5 of the rotating member 3 is intended to be orthogonal to an X-Y plane. As mentioned above, there will, however, in practice be a certain eccentric and inclination error between the shaft 5 of the rotating member 3 and the center axis of the disk 6. This error causes the shaft 5 of the rotating member 3 not to rotate perfectly about the center axis of the disk 6. Since the shaft 5 is permanently fixed to the disk, the lower end of the shaft 5 will instead move in a circle about the center axis of the disk 6. The casing 8 is connected to the frame 1 by means of a strut 15, see FIGS. 1 and 2, which however allows motions, generated by the eccentric and inclination error, of the casing 8 about the strut mounting, see FIG. 2. This motion results in the angle transducer 4 cyclically supplying incorrect information on the rotational angular position of the antenna 2.

According to the invention, instead of the strut 15 there is arranged adjacent to or round the rotating member 3 a connector 10, which is displaceably fixed in the X direction to the casing 8 and displaceably fixed in the Y direction to the frame 1 and is torsionally rigid in respect of the rotation about the antenna shaft 5. The X-Y directions are perpendicular to each other and to the antenna shaft 5.

As a result, the connector 10 prevents rotation of the rotating member outside the center axis of the antenna, which rotation would cause errors in the angle transducing. The connector 10 directs the motions caused by the forces to merely motions in the X-Y direction in a plane perpendicular to the antenna shaft. Motions in the X-Y direction do not affect the angle transducing. The resulting forces get an outlet, and the stress on the suspension device decreases. Thus, the invention allows merely motion in the X-Y direction and prevents rotational displacement of the stationary part, so that angle errors do not arise.

Figure 5:
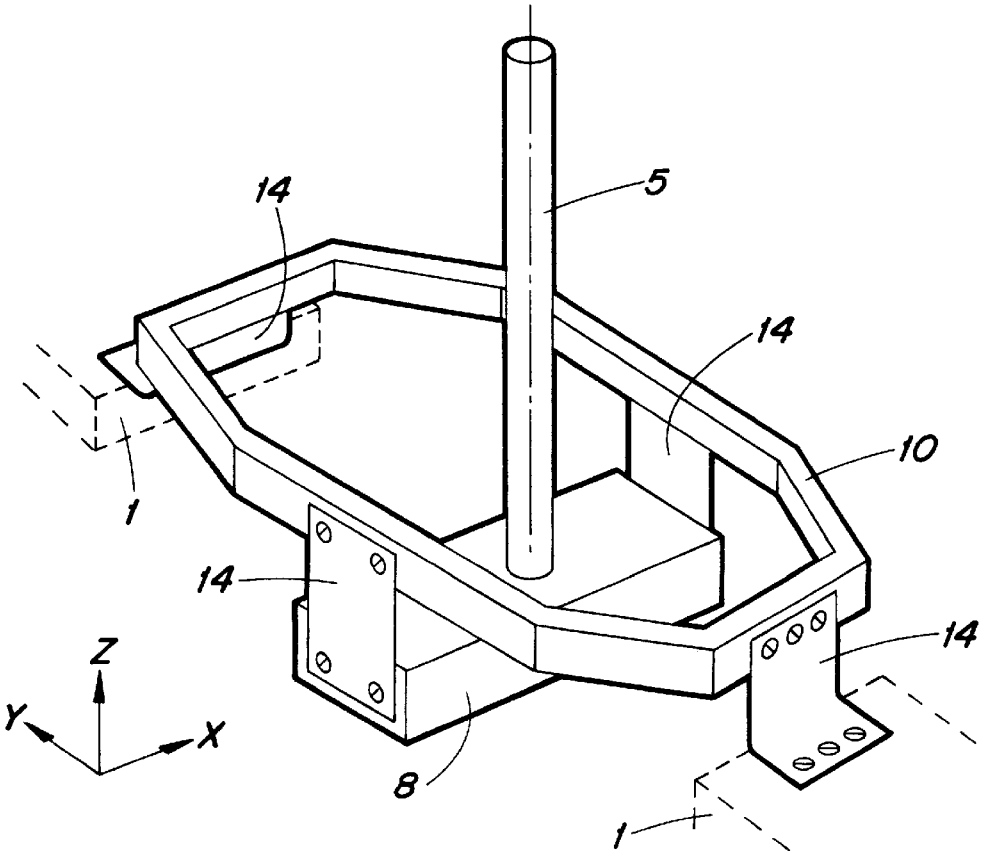
FIG. 5 is a perspective view of a connector.
Figure 10:
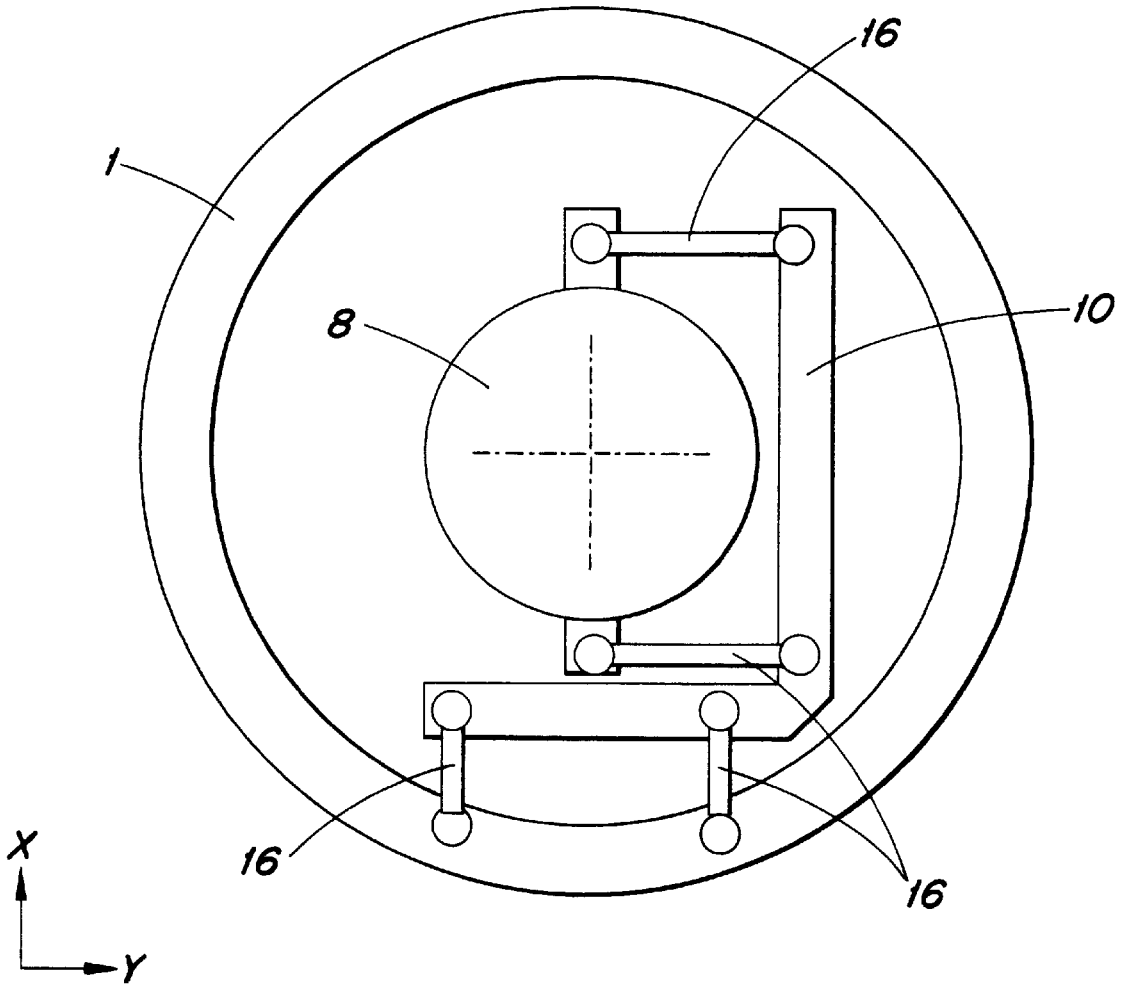
FIG. 10 illustrates a variant of the embodiment in FIG. 9.
Figure 11:
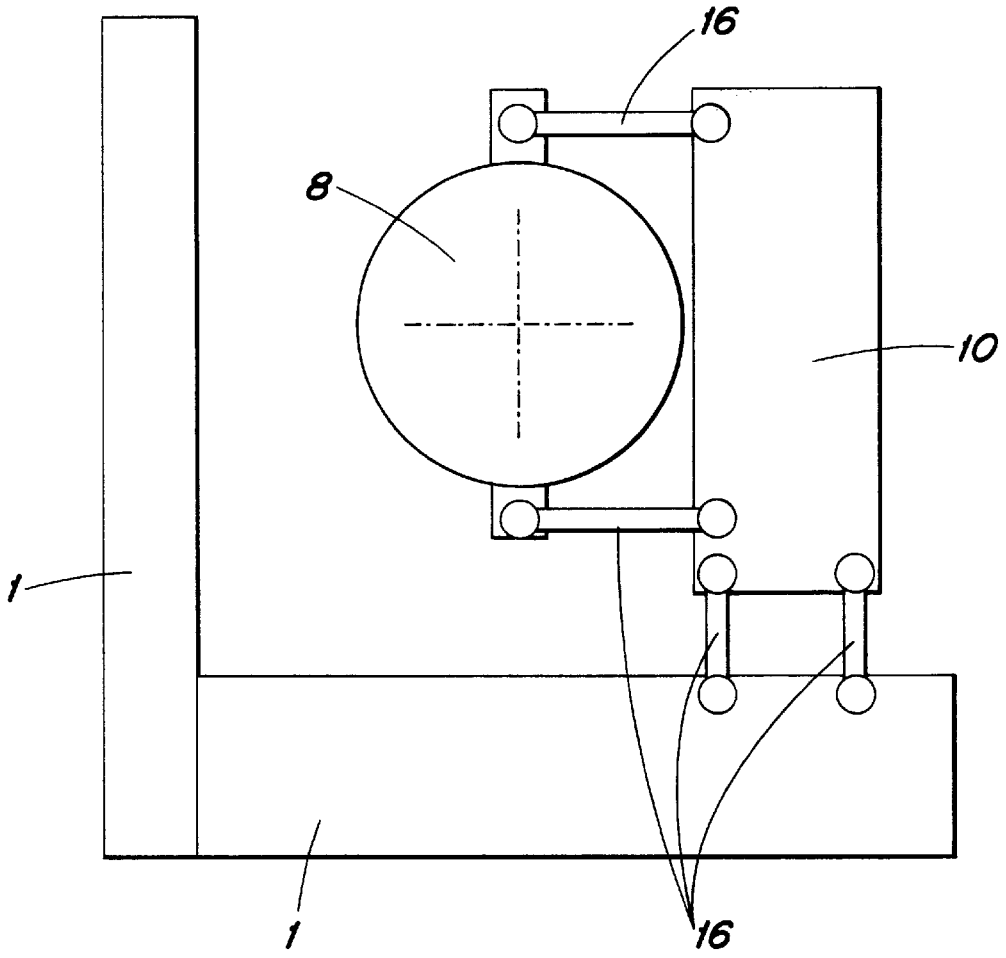
FIG. 11 shows one more variant of the embodiment in FIG. 9
Figure 12:
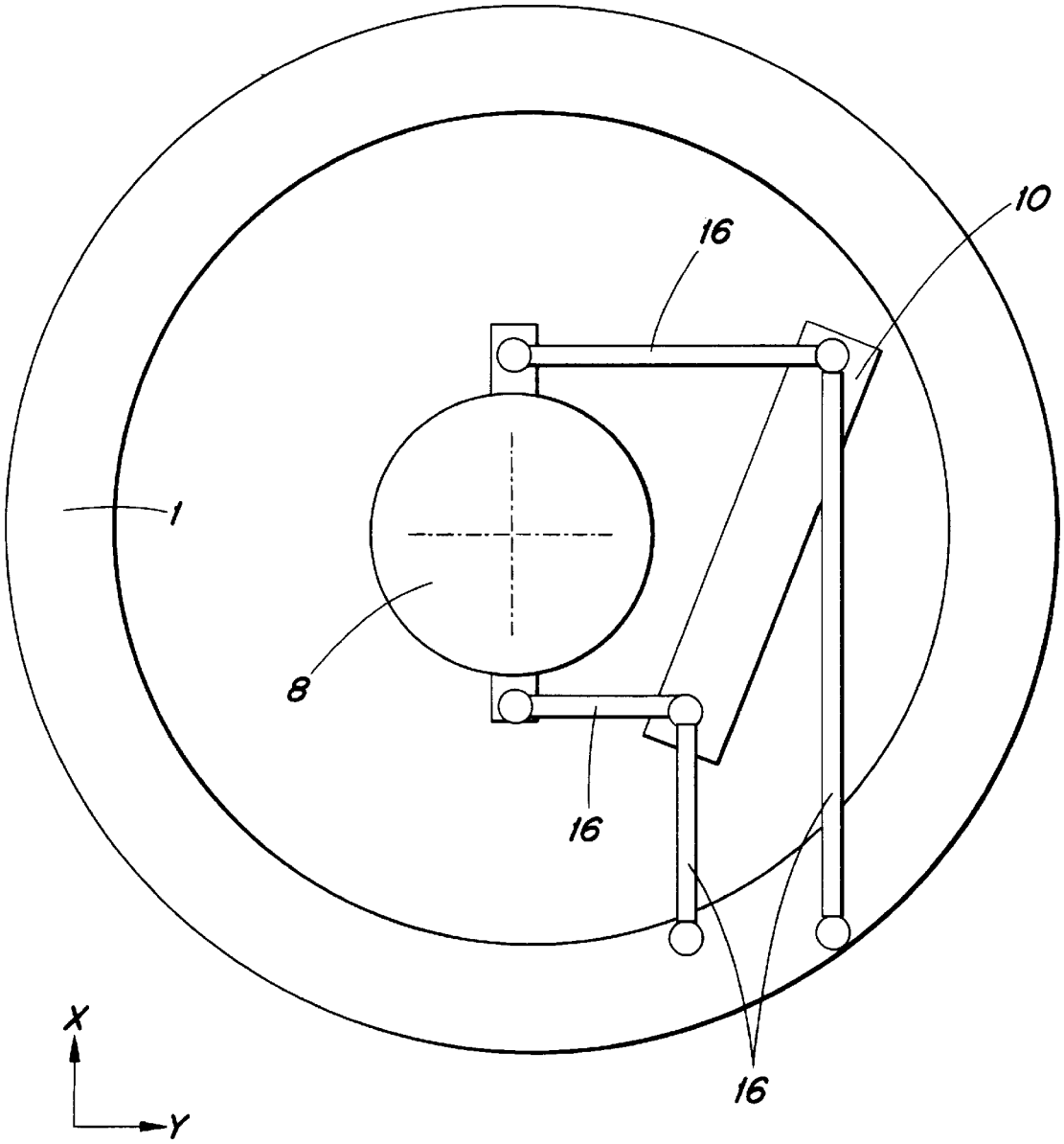
FIG. 12 shows a further variant of the embodiment in FIG. 9.

The connector 10 can be a rigid ring or a polygonal peripheral member, i.e. with a hole for receiving the rotating member 3, see FIG. 5, or a portion of a peripheral member, see FIGS. 10 and 12, or a separate member, see FIG. 11.

Figure 3:
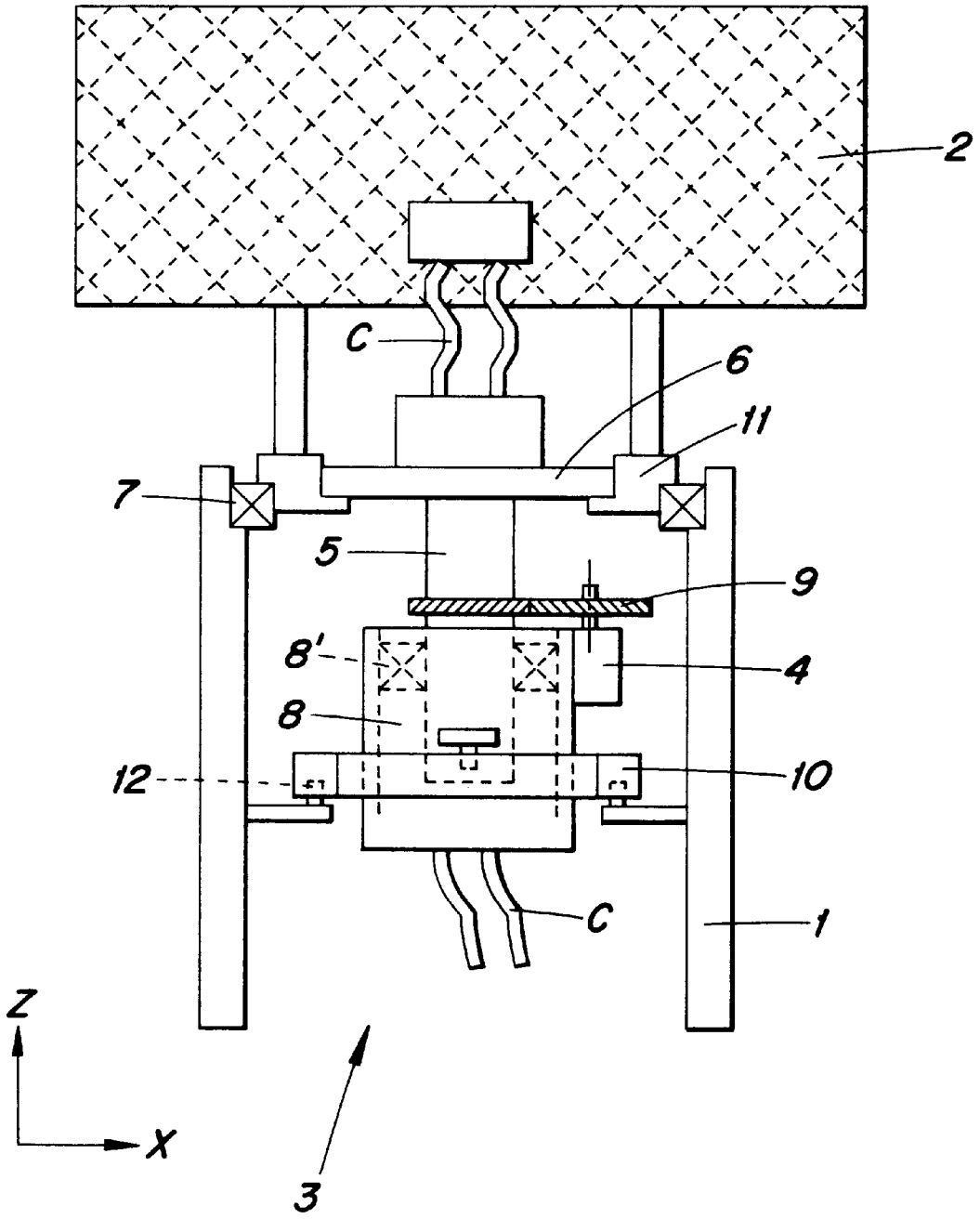
FIG. 3 is a schematic view of a suspension device according to a preferred embodiment of the present invention.
Figure 4:
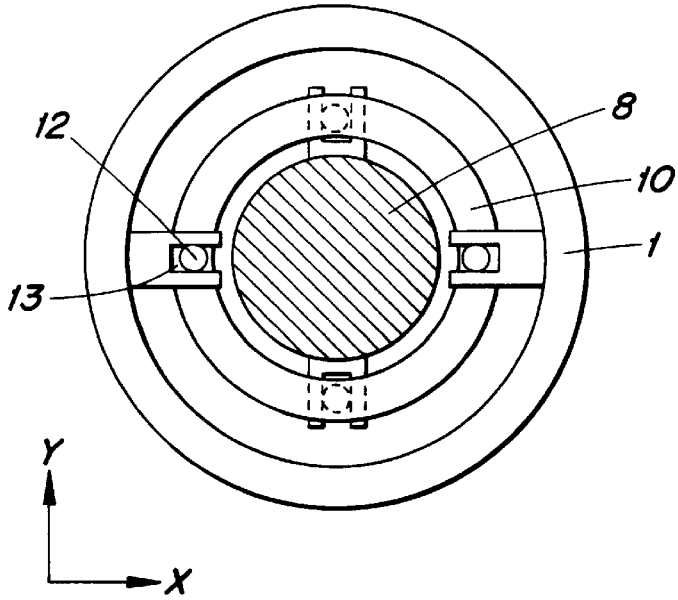
FIG. 4 is a bottom view of the preferred embodiment.

In a first embodiment of the present invention, said displaceable mounting is accomplished by means of pins 12 sliding in grooves 13. See FIGS. 3 and 4. A pair of pins 12 are diametrically arranged on the connector 10 and slide in grooves 13 arranged on the casing 8 in the X direction, and one more pair of diametrically arranged pins 12, which are offset 90 degrees from the first pair, slide in grooves 13 which are arranged in the frame 1 in the Y direction. Alternatively, the pins 12 can be arranged on the frame 1 and the casing 8, respectively, and the grooves in the X-Y direction on the connector 10. It goes without saying that the groove-pin arrangements can also be formed in a mixed manner, for instance, the pins 12 in the X direction are arranged on the connector 10 with corresponding grooves 13 in the frame 1, and the pins 12 in the Y direction are arranged on the casing 8 with corresponding grooves 13 in the connector 10, or one pin 12 is arranged in the X direction on the connector 10 and the other pin 12 in the X direction on the frame 1. The pins 12 can be directed upwards or downwards depending on which construction is best suited for each individual construction with regard to the surroundings. The number of pins 12 with corresponding grooves 13 is not limited to that mentioned and shown in this embodiment.

The grooves 13 themselves need not be without play as long as the antenna 2 rotates in one direction only since the pins 12 then always move along the same side of the groove 13.

In another embodiment, the displaceable mounting, which besides is without play, is provided by arranging linear bearings (not shown) between the connector 10 and the casing 8 in the X direction and between the connector 10 and the frame 1 in the Y direction. Then the antenna 2 can rotate in both directions without any angle deviation arising owing to play. At least one bearing for each direction is required.

Figure 6:
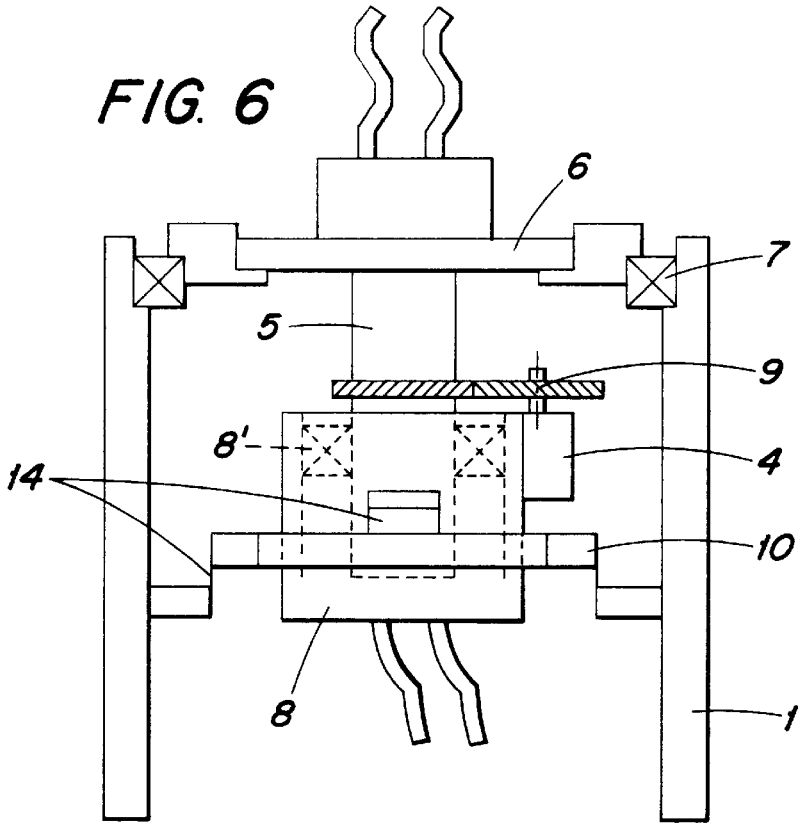
FIG. 6 illustrates a further embodiment of the present invention.

In a third embodiment, see FIGS. 5 and 6, metal plates 14, which are fixed between the connector 10 and the casing 8, can flex in the X direction (their transverse extent is in the X direction), and metal plates 14, which are likewise fixed between the connector 10 and the frame 1, can flex in the Y direction (their transverse extent is in the Y direction). The metal plates are fixed by means of, for instance, screw or rivet joints.

Figure 9:
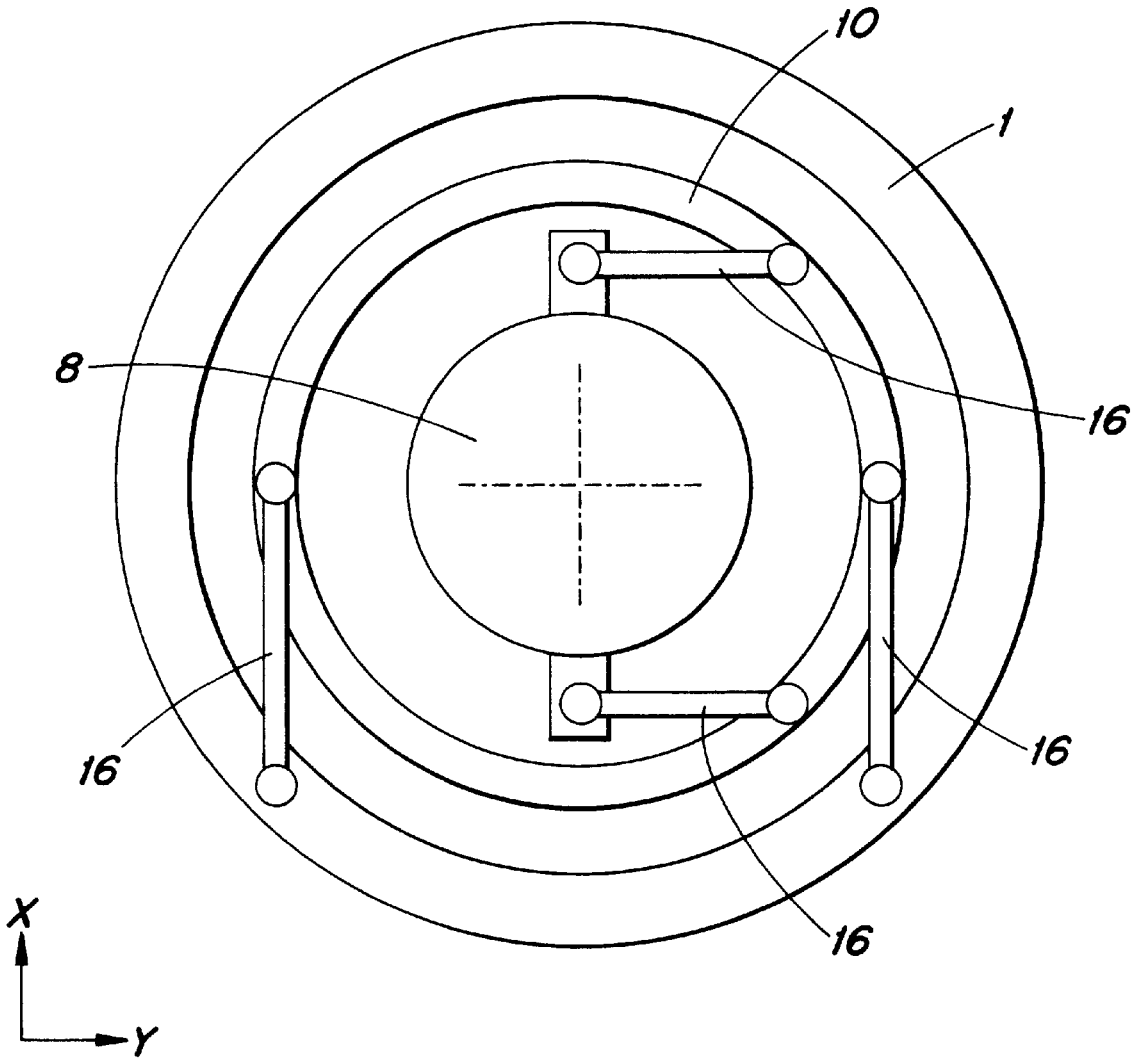
FIG. 9 illustrates yet another embodiment of the present invention.

FIG. 9 illustrates a fourth embodiment, in which the connector 10 is fixed to the casing 8 by means of a pair of pivotable link arms 16 which are arranged orthogonally to the direction of displacement in the X direction, the connector 10 further being fixed to the frame 1 by means of a pair of pivotable link arms 16 which are arranged orthogonally to the direction of displacement in the Y direction. The second pair of link arms 16 are off-set 90 degrees from the first pair.

In FIGS. 10 and 11, the connector 10 has a shape different from that described above. In FIG. 10, the connector consists merely of part of a peripheral member and has the shape of an L, and in FIG. 11 the connector consists of a rectangular plate, but it goes without saying that the connector can have any shape whatever. With such designs of the connector 10, it can be mounted without having to be slipped over the casing 8 or the shaft 5, but it is necessary to have an increased material thickness or a material with increased rigidity so that a rigidity like in a closed ring is obtained. The connector 10 is fixed to the casing 8 by means of a pair of pivotable link arms 16, as shown in FIG. 9. Moreover, the connector 10 is fixed to the frame 1 by means of a pair of pivotable link arms 16, as shown in FIG. 9.

FIG. 12 shows a simplified variant of the embodiment according to FIG. 9 where the connector 10 is fixed to the casing 8 by means of a pair of pivotable link arms 16 of different length, which are arranged orthogonally to the direction of displacement in the X direction, the connector 10 further being fixed to the frame 1 by means of a pair of pivotable link arms 16 which are arranged orthogonally to the direction of displacement in the Y direction. The points of fixation for the link arms 16 at the connector 10 coincide so that only two points of fixation is provided at the connector 10.

Figure 13:
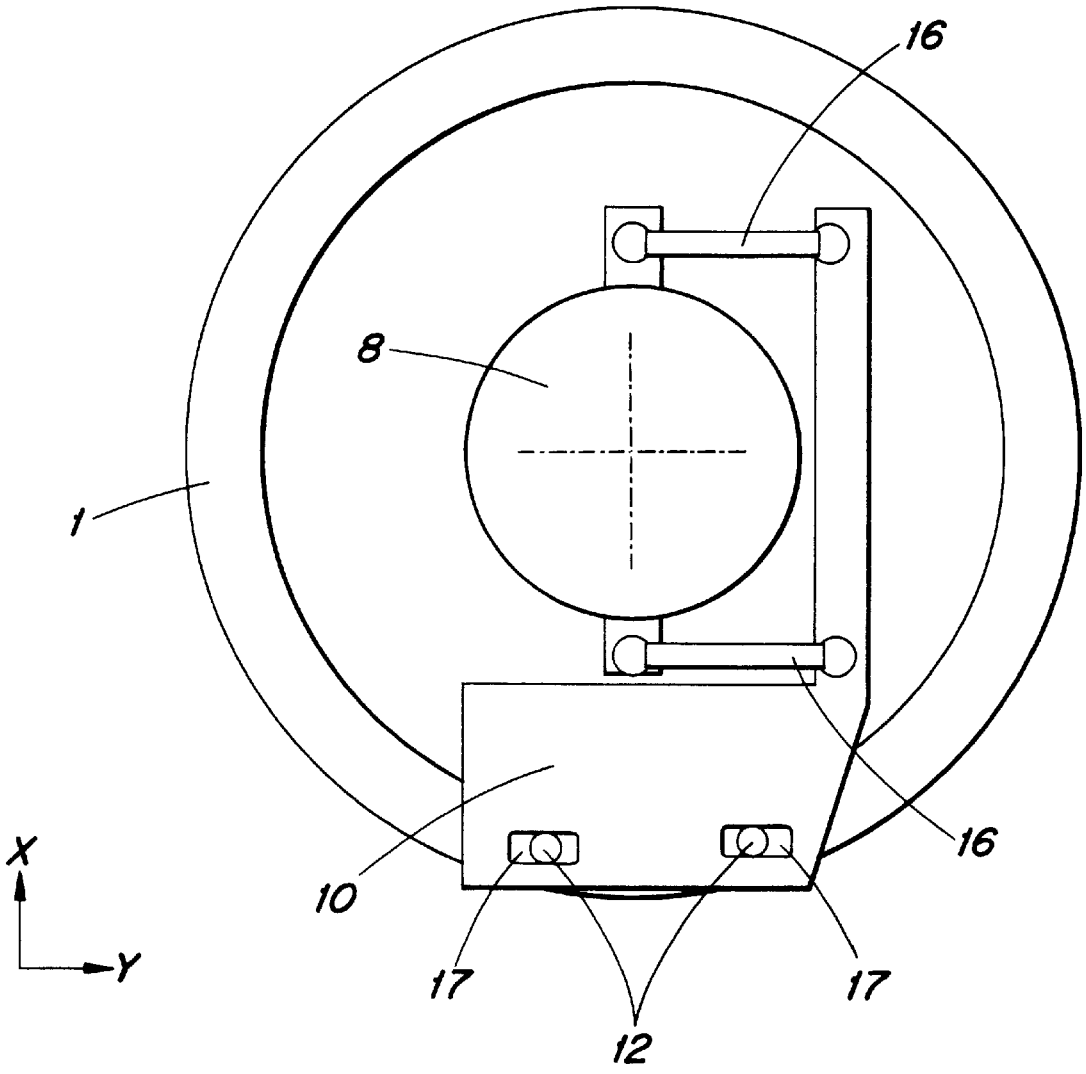
FIG. 13 shows one more embodiment of the present invention.

FIG. 13 shows a connector 10 similar to the one in FIG. 10. In this fifth embodiment, pivotable link arms 16 are used to fix the connector 10 to the casing 8, so that the connector 10 is displaceable in the X direction, as explained above in connection with FIG. 9. Furthermore, the connector 10 is displaceably fixed in the Y direction by means of two grooves 17 extending in the Y direction and cooperating with a pair of pins 12 which are arranged in the frame. The grooves 17 can be arranged in alignment or in parallel with each other or can be formed as a single groove 17. Of course, the grooves can be arranged in the frame 1 instead, and the pins in the connector 10. As understood by a person skilled in the art, a pin and groove arrangement can be arranged in the X direction instead of the link arms 16, similar to the arrangement in the Y direction.

Figure 7:
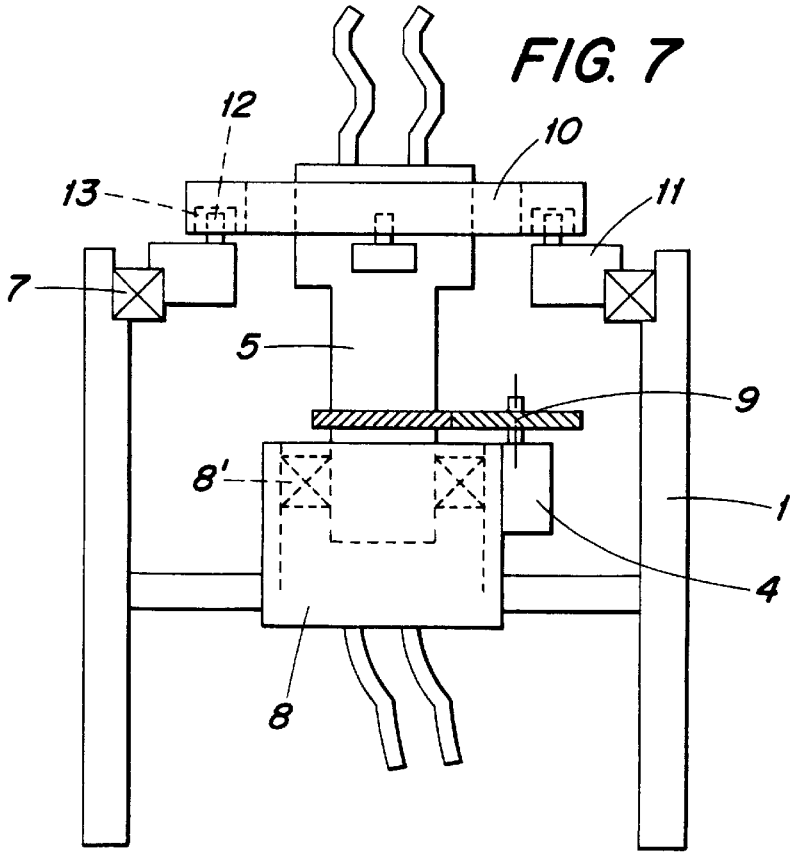
FIG. 7 illustrates one more embodiment of the present invention.
Figure 8:
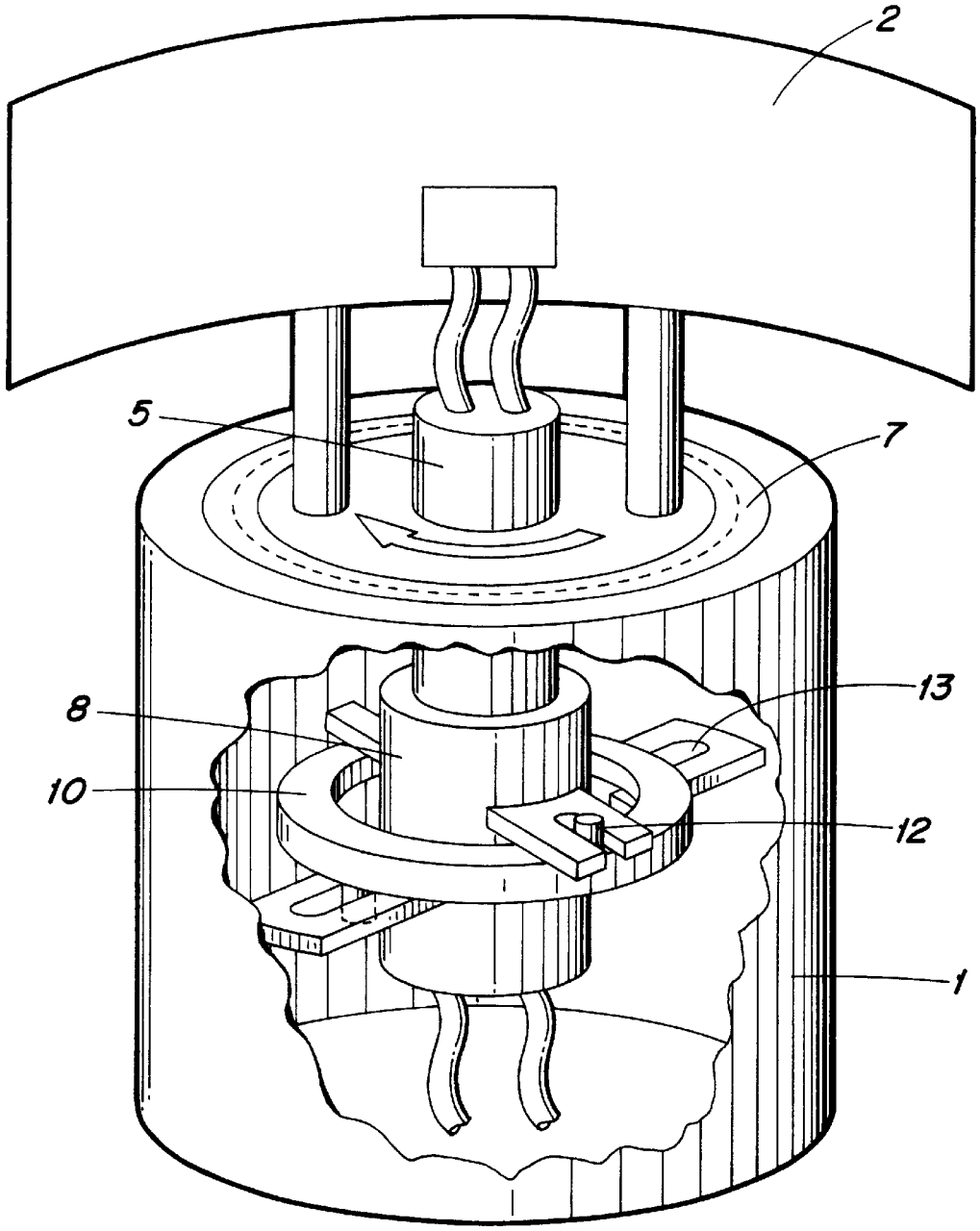
FIG. 8 is a perspective view of the preferred embodiment according to FIGS. 3 and 4.

FIG. 7 illustrates a sixth embodiment, in which the stationary part is fixedly mounted in the frame 1, the connector 10 being displaceably fixed in the X direction to the shaft 5 of the rotating member 3 and displaceably fixed in the Y direction to a power operated antenna mounting 11, which corresponds to the disk 6 in the embodiment described above.

The shaft 5, the connector 10 and the antenna mounting 11 rotate as a single unit, the X-Y plane being defined in relation to the shaft 5, i.e. the X-Y plane is not stationary but rotates with the shaft 5.

The antenna mounting 11 or the disk 6 is then mounted with a play between itself and the shaft 5 of the rotating member 3 to allow instead motion of the shaft 5 relative to the disk 6 or the antenna mounting 11 in the X-Y plane.

The displaceable mounting in this embodiment can be carried out according to one of the methods described above.

The Figures illustrate an angle transducer 4 which is arranged on the housing 8 and connected to the shaft 5 of the rotating member 3 by means of a gear 9. The angle transducing can also be carried out by means of an apertured disk arranged on the shaft 5 of the rotating member 3 and an optical reader is arranged on the casing 8 for reading the apertured disk and, thus, the roational angular position. Alternatively, the apertured disk can be an electromagnetic reader, for instance a resolver. One or two angle transducers 4 can engage the shaft 5 of the rotating member 3 by means of a gear. It goes without saying that also other methods can be used.

The invention is not limited to that described above and shown in the drawings but can be modified within the scope of the claims.

What I claim and desire to secure by Letters Patent is:

1. A suspension device for rotatable appliances which are connectable with a frame-mounted shaft which extends through a power operated mounting and which, beyond the mounting, has a free end mounted in a stationary part, which is capable of limited motion generated by insufficient concentricity between the mounting and the shaft, for which an angle-transducing device is provided, comprising:

a connector, which is arranged adjacent to or around the shaft and directs components of force on the stationary part, which have arisen owing to insufficient concentricity, to merely displacement in the X-Y direction in a plane perpendicular to the shaft by the connector being displaceably fixed in the X direction to the stationary part and displaceably fixed in the Y direction to a frame.

2. A suspension device as claimed in claim 1, wherein the connector is displaceably fixed in the X direction to the stationary part by means of a pair of diametrically arranged pins which cooperate with grooves, and the connector is displaceably fixed in the Y direction to the frame by means of a further pair of diametrically arranged pins which cooperate with grooves.

3. A suspension device as claimed in claim 2, wherein the connector is adapted to completely enclose the shaft.

4. A suspension device as claimed in claim 2, wherein the connector is adapted to at least partly enclose the shaft.

5. A suspension device as claimed in claim 1, wherein the connector is displaceably fixed in the X direction to the stationary part by means of at least one linear bearing, and the connector further is displaceably fixed in the Y direction to the frame by means of at least one linear bearing.

6. A suspension device as claimed in claim 1, wherein the connector is displaceably fixed in the X direction to the stationary part by means of a pair of diametrically arranged flexible metal plates, and the connector further is displaceably fixed in the Y direction to the frame by means of a further pair of diametrically arranged flexible metal plates.

7. A suspension device as claimed in claim 6, wherein the flexible metal plates are oriented in such manner that the X and Y directions are orthogonal to the vertical and horizontal axes of the metal plates.

8. A suspension device as claimed in claim 6, wherein the connector is adapted to completely enclose the shaft.

9. A suspension device as claimed in claim 1, wherein the connector is fixed to the stationary part by means of a pair of link arms which are arranged in parallel in the X direction and pivotable, so that the connector is displaceable in the Y direction, and the connector further is fixed to the frame by means of a further pair of link arms which are arranged in parallel in the Y direction and pivotable, so that the connector is displaceable in the X direction.

10. A suspension device as claimed in claim 1, wherein the connector is fixed to the stationary part by means of a pair of link arms which are arranged in parallel in the X direction and pivotable, so that the connector is displaceable in the Y direction, and the connector further is displaceably fixed in the X direction to the frame by means of a pair of pins which cooperate with at least one groove which is oriented in the X direction.

11. A suspension device as claimed in claim 1 , wherein the connector is adapted to completely enclose the shaft.

12. A suspension device as claimed in claim 1, wherein the connector is adapted to at least partly enclose the shaft.

13. A suspension device for rotatable appliances which are connectable with a frame-mounted shaft which extends through a power operated mounting and which, beyond the mounting, has a free end mounted in a stationary part, which is capable of limited motion generated by insufficient concentricity between the mounting and the shaft, for which an angle-transducing device is provided, comprising:

a connector, which is arranged adjacent to or around the shaft and directs components of force on the stationary part, which have arisen owing to insufficient concentricity, to merely displacement in the X-Y direction in a plane perpendicular to the shaft by the connector being displaceably fixed in the X direction to the shaft and displaceably fixed in the Y direction to the mounting.

14. A suspension device as claimed in claim 13, wherein the connector is displaceably fixed in the X direction to the shaft by means of a pair of diametrically arranged pins which cooperate with grooves, and the connector further is displaceably fixed in the Y direction to the mounting by means of a further pair of diametrically arranged pins which cooperate with grooves.

15. A suspension device as claimed in claim 13, wherein, the connector is displaceably fixed in the X direction to the shaft by means of at least one linear bearing, and the connector further is displaceably fixed in the Y direction to the mounting by means of at least one linear bearing.

16. A suspension device as claimed in claim 13, wherein the connector is displaceably fixed in the X direction to the shaft by means of a pair of diametrically arranged flexible metal plates, and the connector further is displaceably fixed in the Y direction to the mounting by means of a further pair of diametrically arranged flexible metal plates.

17. A suspension device as claimed in claim 16, wherein the flexible metal plates are oriented in such a manner that the X and Y directions are orthogonal to the vertical and horizontal axes of the metal plates.

18. A suspension device as claimed in claim 13, wherein the connector is fixed to the shaft by means of a pair of link arms which are arranged in parallel in the X direction and pivotable, so that the connector is displaceable in the Y direction, and the connector further is fixed to the mounting by means of a further pair of link arms which are arranged in parallel in the Y direction and pivotable, so that the connector is displaceable in the X direction.

19. A suspension device as claimed in claim 13, wherein the connector is fixed to the shaft by means of a pair of link arms which are arranged in parallel in the X direction and pivotable, so that the connector is displaceable in the Y direction, and the connector further is displaceably fixed in the X direction to the mounting by means of pair of pins which cooperate with at least one groove which is oriented in the X direction.

20. A suspension device as claimed in claim 13, wherein the connector is adapted to completely enclose the shaft.

21. A suspension device as claimed in claim 13, wherein the connector is adapted to at least partly enclose the shaft.

* * * * *